United States Patent [19]

Wentworth

[11] Patent Number: 4,564,148

[45] Date of Patent: Jan. 14, 1986

[54] TOILET PAPER DISPENSING SYSTEM

[76] Inventor: Michael B. Wentworth, 7015 Buckingham Rd., Berkeley, Calif. 94705

[21] Appl. No.: 624,061

[22] Filed: Jun. 25, 1984

[51] Int. Cl.[4] ..... B65H 19/04

[52] U.S. Cl. ..... 242/55.3; 242/55.53

[58] Field of Search ..... 242/55.2, 55.3, 55.53; 312/38, 39, 40; 225/34, 47

[56] References Cited

U.S. PATENT DOCUMENTS

| | | | |
|---|---|---|---|
| 2,299,736 | 10/1942 | Cavoto | 242/55.3 |
| 2,429,571 | 10/1947 | Usenza | 242/55.53 |
| 2,554,849 | 5/1951 | Anderson | 242/55.53 |
| 2,603,427 | 7/1952 | Holmes | 242/55.3 |
| 2,605,975 | 8/1952 | Page et al. | 252/55.3 |
| 2,758,800 | 8/1956 | McCarts | 242/55.3 |
| 3,130,932 | 4/1964 | Pena | 242/55.3 |
| 3,279,715 | 10/1966 | Vedvig | 242/55.3 |
| 3,382,021 | 5/1968 | DeWoskin | 312/39 |
| 3,598,331 | 8/1971 | Okamura | 242/55.3 |
| 3,690,580 | 9/1972 | Jespersen | 242/55.3 |
| 4,098,469 | 7/1978 | McCarthy | 242/55.3 |
| 4,108,389 | 8/1978 | Womack | 242/55.3 |

*Primary Examiner*—Leonard D. Christian

*Attorney, Agent, or Firm*—Townsend & Townsend

[57] ABSTRACT

A toilet paper dispenser (5) includes a roll-storing chamber (20) adapted for incorporation behind a room wall and a pair of facing guides for feeding rolls (10, 12), one at a time, to an exposed position at least partially in front of the wall. To this end, the chamber (20) has a front wall (35) formed with an opening (42) in a lower portion thereof commensurate with an aperture (30) in the room wall. Each of the facing guides includes a vertical channel (60) within the chamber (20) and a horizontal channel (62) contiguous therewith and extending to a point outside the chamber. The channels are sized and spaced to accommodate spindle ends (27) projecting beyond the end faces of a toilet paper roll to be dispensed. The end portions (67) of the horizontal channels are formed to support a roll in the exposed use position. One or both of the horizontal channels (62) may be formed with an open segment (75) that allows insertion and removal of the spindle.

13 Claims, 6 Drawing Figures

TOILET PAPER DISPENSING SYSTEM

FIELD OF THE INVENTION

The present invention relates generally to cabinets and the like for dispensing rolls of material, and more specifically to a built-in dispenser for rolls of toilet paper.

BACKGROUND OF THE INVENTION

Even the most casual observer of the human condition will have noted that the ability to meet a given need at a given time seems to vary inversely with the degree of such need at such time. Thus, a temporary need for a given object is often accompanied by a corresponding inaccessibility, albeit temporary, of the needed object.

It is at least partly in recognition of this cruel irony that there have been developed a variety of devices for storing and dispensing rolls of toilet paper. Each of such devices includes a cabinet in which toilet paper rolls are stacked and a mechanism for bringing the lowermost roll into an operative, accessible position where it may be supported on a spindle for use.

Most of the devices are mounted to a wall, typically for use in public lavatory facilities. U.S. Pat. Nos. 3,690,580 to Jespersen and 4,098,469 to McCarthy show representative devices of this type. It is also known to build such devices into a wall, as may be seen in U.S. Pat. Nos. 2,603,427 to Holmes, 3,130,932 to Pena, and 3,279,715 to Vedvig. The Pena and Holmes devices provide built-in chambers with top and bottom openings while the Vedvig device has a single opening at the bottom.

The prior art devices have all faced a common problem, namely how to keep the stack of reserve rolls from interfering with the roll that is in use. To this end, a variety of stop arrangements have been developed, typically including a restraining member that is swung, slid, bent, or otherwise moved into and out of position. In some devices the restraining member is totally independent of the roll-supporting structure, while in others, such as the Holmes device, the restraining member and the support exhibit a degree of cooperation.

While toilet paper dispensers have found widespread use in public facilities, they are seldom found in private homes. The objection may be in part aesthetic, at least with respect to wall-mounted devices. Expense is another consideration, since the devices tend to be somewhat complex. While built-in devices overcome the aesthetic objection, they are typically rather expensive to install, at least with respect to existing construction.

SUMMARY OF THE INVENTION

The present invention provides a built-in toilet paper dispensing system that is simple to use and economical to manufacture and install. The present invention has few or no moving parts, and integrates the roll-restraining feature with the roll-supporting structure. In one embodiment, the invention may be built into an existing room wall through the rectangular aperture ordinarily provided to accommodate a conventional toilet paper holder.

Broadly, the toilet paper dispenser of the present invention includes a roll-storing chamber adapted for incorporation behind a room wall and a pair of facing guides for feeding rolls, one at a time, to an exposed position at least partially in front of the wall. To this end, the chamber has a front wall formed with an opening in a lower portion thereof commensurate with the aperture in the room wall. Each of the facing guides includes a vertical channel within the chamber and a horizontal channel contiguous therewith and extending to a point outside the chamber. The channels are sized and spaced to accommodate spindle ends projecting beyond the end faces of a toilet paper roll to be dispensed. The end portions of the horizontal channels are formed to support a roll in the exposed use position. One or both of the horizontal channels may be formed with an open segment to allow insertion and removal of the spindle.

Thus, toilet paper rolls having projecting spindle ends are fed, one at a time, into the horizontal channels and pushed upwardly into the chamber between the vertical channels. A number of rolls are thus held in stacked relation while an additional roll is loaded at the use position. When the exposed roll is finished, the spindle is removed and the lowermost roll in the chamber is pulled along the horizontal channels to the use position.

The spindle for supporting each roll may be implemented as a solid spindle sized for insertion through the roll core or may be implemented as a pair of end caps, sized for insertion into opposite ends of the core and having projecting extensions that define the spindle ends. In the latter case, the end caps cooperate with the core to define the spindle. The chamber may be formed with a compartment below the bottom of the opening to store spindles or end caps, as the case may be.

The invention contemplates incorporation of the chamber into the cavity of a standard double wall. Nominal 2×4 studs define an interstice of approximately 3½ inches which is smaller than the diameter of normal commercially available toilet paper rolls. The invention thus contemplates using specially wound toilet paper rolls having a normal amount of paper wound more tightly on a smaller diameter core (approximately 1 inch).

The invention preferably comprises two subassemblies. The first subassembly, which is mounted behind the room wall, includes the chamber, the vertical channels, and portions of the horizontal channels. The second subassembly, which is mounted in front of the room wall, includes the portions of the horizontal channels that project into the room and hold the rolls in their use position.

The first subassembly may be of modular snap-together construction, each portion of which is small enough to be installed through the rectangular aperture in the room wall. Thus, the chamber can be installed and assembled within the wall cavity without damaging the finished wall. The modularity also allows varying the height (and thus storage capacity) of the chamber in response to different circumstances or requirements.

A further understanding of the nature and advantages of the present invention may be realized by reference to the remaining portions of the specification and the attached drawings.

DESCRIPTION OF THE PREFERRED EMBODIMENTS

Figure 1:
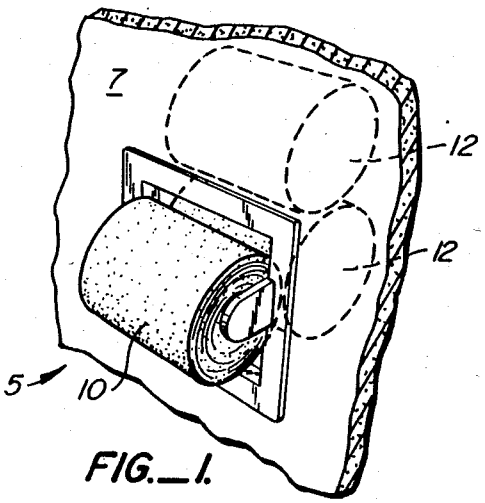
FIG. 1 is a perspective view of the invention as installed.

FIG. 1 is a perspective view of a first embodiment of a toilet paper dispenser 5 as incorporated into a wall 7, a portion of which is shown. Dispenser 5 operates to keep a toilet paper roll 10 at an accessible position in front of the wall while maintaining a plurality of reserve rolls 12 (shown in phantom) stacked behind the wall. In the discussion that follows, "front" refers to the direction toward the room interior while "rear" and "behind" refer to the opposite direction. References to vertical direction refer to the normal orientation of dispenser 5.

Wall 7 is of standard construction wherein wallboard is nailed or otherwise fastened to a stud framework. Dimensions in construction are relatively standard in that a standard 2×4 stud is sized to define an interstice within the wall of approximately 3.5 inches. Wallboard comes in various thicknesses, but 0.5 inches is fairly common.

As a threshold matter, it should be noted that the invention generally contemplates the use of toilet paper rolls having a non-standard configuration. More particularly, a standard toilet paper roll is wound on a core having a diameter of about 1.5 inches with an outer roll diameter of about 4.5 inches. Since the invention contemplates incorporation into a standard stud wall, the toilet paper rolls for use with the invention must have a diameter generally on the order of 3–3.25 inches. A toilet paper roll meeting this constraint on outer diameter may still provide as much toilet paper as a standard roll by having such a roll wound more tightly than normal on a core that is smaller than normal. While considerations relevant to the invention would tend to dictate as small a core diameter as possible, $1\frac{1}{8}$ inches is preferred so that the special rolls may be used with standard spindles and holders if desired.

Figure 2:
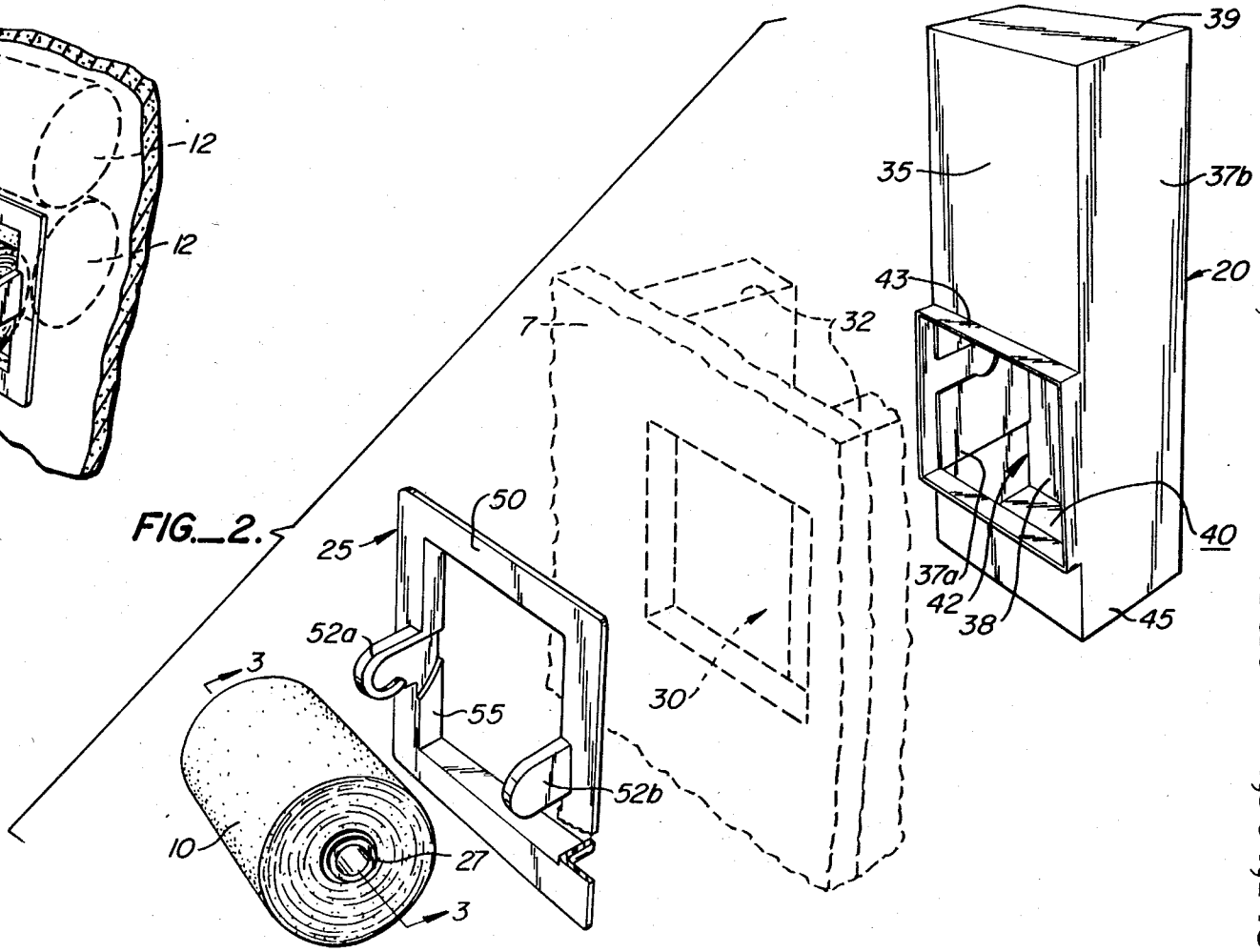
FIG. 2 is an exploded perspective view of a first embodiment of the invention.

FIG. 2 is an exploded perspective view of dispenser 5 with its main subassemblies dissociated from wall 7. A first subassembly defines a chamber 20 which is located behind wall 7, and has the function of storing rolls 12 in stacked overlying relation so that they do not interfere with roll 10. A second subassembly defines a roll holder 25 which is located in front of the wall, and has the main function of holding roll 10 in position for use. Roll holder 25 is designed for use with toilet paper rolls having spindle ends projecting beyond the rolls' end faces. One such spindle end 27 may be seen in the figure. Chamber 20 and roll holder 25 are preferably of molded plastic construction.

In broad terms, subassemblies 20 and 25 cooperate with one another through an aperture 30 formed in wall 7. Aperture 30 has a preferred dimension of 5×5 inches which corresponds to the dimension for conventional recessed toilet paper holders. Where the invention is installed prior to the installation of the wallboard, studs 32 may be provided on each side of aperture 30.

When chamber 20 and roll holder 25 are assembled, they cooperatively define a pair of L-shaped guides which cooperate with spindle ends 27 (one of which is visible) projecting beyond the end faces of rolls 10 and 12 in order to maintain rolls 12 within the chamber and roll 10 at its exposed position outside the chamber. Chamber 20 includes a front wall 35, opposed side walls 37*a* and 37*b*, a rear wall 38, a top 39, and a bottom 40. Front wall 35 is formed at its lower portion with an opening 42 having an outwardly-projecting peripheral flange 43. Opening 42 is preferably formed somewhat above the bottom of the chamber 20 so as to define a bottom compartment 45.

Roll holder 25 includes a frame 50 which carries a pair of opposed roll-supporting members 52*a* and 52*b*. Roll-supporting members 52*a–b* define terminal portions of the L-shaped guides as will be described below. Frame 50 carries a flange 55 that is sized for telescoping engagement with flange 43 on chamber 20. Thus, flange 43 is passed through aperture 30 in wall 7, and flange 55 is telescoped into it so as to bring frame 50 flush with the front surface of wall 7.

Figure 3:
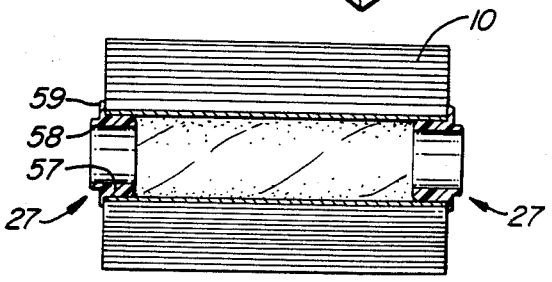
FIG. 3 is a sectional view taken along line 3—3 of FIG. 2.

FIG. 3 is a cross-sectional view taken along line 3—3 of FIG. 2 showing the manner in which the spindle for roll 10 is defined. The same construction applies to rolls 12 as well. Roll 10 is wound on a tubular cardboard core 56, and is fitted with a pair of end caps that cooperate with roll core 56. Each end cap comprises coaxial cylindrical body portions 57 and 58 and an intermediate annular flange 59. Body portion 57 is sized for insertion into core 56 while portion 58 defines the actual spindle end. Flange 59 limits axial movement so as to permit the axial dimension of the spindle to be established precisely. A 4.75-inch axial dimension is preferred for a chamber having a 5-inch maximum exterior width. Body portion 59 may have a diameter less than that of body portion 58, say $\frac{7}{8}$-inch. A $\frac{1}{8}$-inch axial dimension is suitable.

The spindles may also be implemented as solid spindles sized for insertion through roll core 56. The inner surfaces of the side walls of compartment 45 may be recessed slightly to allow solid spindles to fit with their axes parallel to wall 7.

Figure 4:
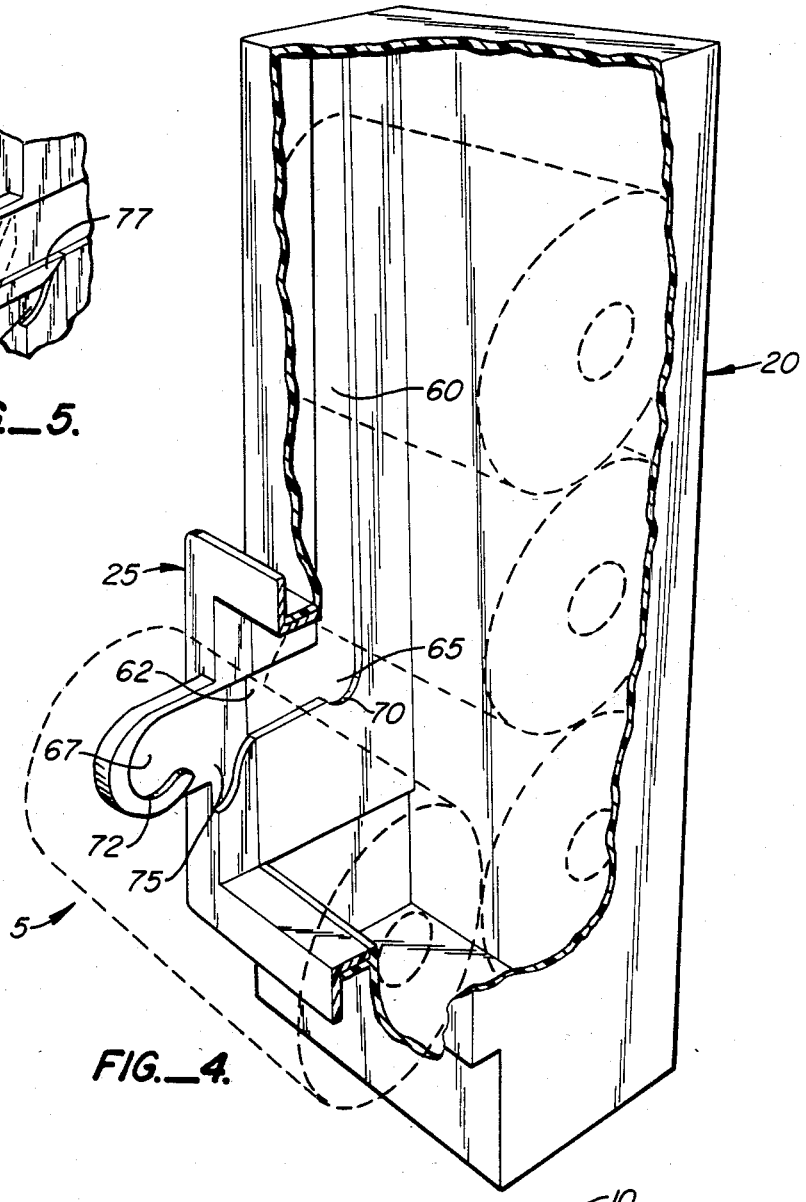
FIG. 4 is a cut-away perspective view of the first embodiment of the invention.

FIG. 4 is a cut-away perspective view of dispenser 5 with chamber 20 and roll holder 25 assembled. The L-shaped guides are preferably in the form of channels formed in side walls 37*a–b* and roll-supporting members 52*a–b*. Only one guide is shown, the other having been cut away in the figure. It is to be understood that the other guide faces the one shown and is a mirror image thereof. Each guide includes a vertical channel 60 and a horizontal channel 62, each channel being formed with opposed edges spaced to accommodate the outer diameter of spindle ends 27. The two guides are spaced from each other to accommodate the axial dimension of the spindle. The channels must also be deep enough to capture the spindle. A $\frac{1}{8}$-inch depth (which is commensurate with end cap body portion 58) is appropriate.

Vertical channel 60 extends downwardly from top 39 of chamber 20 to a region 65 slightly above the center of opening 40. Horizontal channel 62 extends away from region 65 to a terminal region 67. Channel 60 preferably extends slightly below the lower edge of horizontal channel 62 to define a first shallow arcuate trough 70 having a curvature generally corresponding to the radius of spindle end 27. Similarly, horizontal channel 62 is formed with a downward extension at terminal region 67 to define a second shallow arcuate trough 72. Horizontal channel 62 is preferably formed with an open segment which defines an opening 75 proximate terminal region 67. Opening 75 is sized to accommodate a spindle end. While vertical channels 60 are parallel to permit the spindles to slide freely, horizontal channels 62 may converge toward one another at terminal regions 67 to hold the spindle somewhat more firmly.

The operation of dispenser system 5 will now be described. A number of rolls are fitted with spindle end caps, and are fed, one at a time, into openings 75, inwardly along horizontal channels 62, and upwardly along vertical channels 60. Subsequent rolls are inserted the same way, preferably with a reversing rolling motion that tends to urge the previously inserted roll(s) upwardly. Once chamber 20 is full, with the lowermost roll sitting in troughs 70, the last roll is inserted into openings 75. The rolls in chamber 20 are raised upwardly to provide the clearance necessary for the last roll to enter horizontal channels 62. The last roll is then drawn forward into troughs 72 where it is ready for use. When the roll that is in use is finished, the spindle and core are removed from holder 25 by deforming the core, and end caps 57 are removed and placed in compartment 45. The lowermost roll within chamber 20 is moved slightly upwardly and pulled forward until it sits in troughs 72. Troughs 70 operate as detents to prevent the lowermost reserve roll from moving forward until needed. In the event that horizontal channels 62 are formed without openings 75, sprung telescoping spindles must be used.

Figure 5:
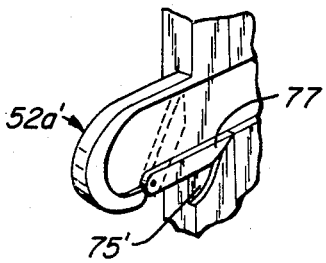
FIG. 5 is a perspective view of an alternate construction for the roll holding members.

The construction of roll-supporting members 52*a–b* is such that the spindle ends of the roll in use are unlikely to slip through openings 75 accidentally. However, that possibility can be substantially eliminated by providing latching elements at the openings. FIG. 5 is a perspective view illustrating an alternate construction for the roll-supporting members that incorporates such latching elements. A roll-supporting member 52*a'* corresponds to member 52 of FIG. 2, and is formed with a corresponding opening 75'. However, member 52*a'* includes a pivoted tongue 85 having a rest position overlying opening 75' to prevent the spindle of the roll in use from accidentally falling through the opening. Tongue 85 can be swung upwardly to a position, shown in phantom, which permits insertion and withdrawal of rolls. A resilient element such as a leaf spring could be used instead of tongue 85.

The above-described embodiment of chamber 20 is easily incorporated into wall prior to the installation of the wallboard. However, with fairly minor modifications, the invention may be rendered capable of incorporation into the wall after construction is finished. More particularly, the chamber subassembly may be of modular snap-together construction with each portion small enough to be installed through aperture 30. Aperture 30 either must be already present, as for example where a standard recessed toilet paper holder is in place, or such an aperture must be provided.

Figure 6:
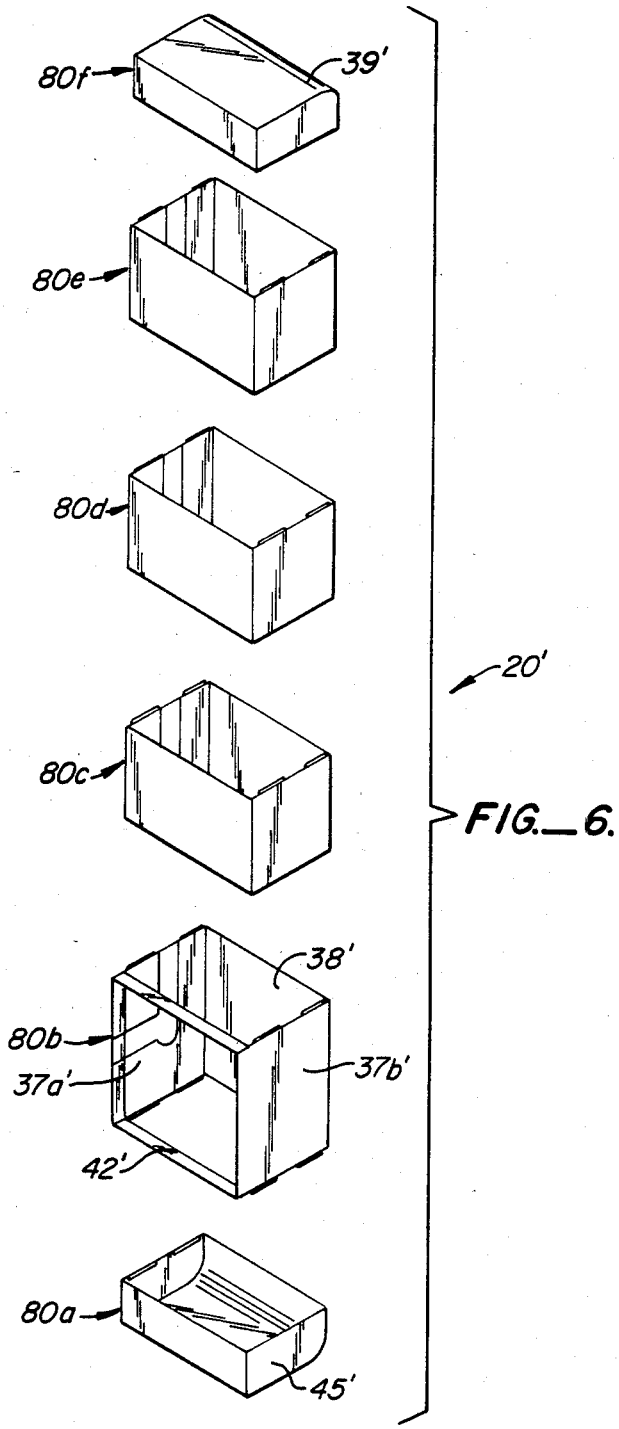
FIG. 6 is an exploded perspective view illustrating a second embodiment of the invention.

FIG. 6 is an exploded perspective view illustrating the components that would go together to form a structure corresponding to chamber 20 of FIG. 2. Primed reference numerals will be used to denote corresponding structural elements. A chamber 20' comprises a plurality of elements 80*a–f*. Element 80*a* defines a lowermost compartment 45' and has a vertical dimension on the order of 1½ inches. Element 80*b* is registered with aperture 30 and includes a peripheral flange 42' and portions of side walls 37*a'–b'* and of rear wall 38'. Items 80*c–e* are identical, each having four wall segments of a height generally equal to one roll diameter. Element 80*f* provides top 39' of chamber 20, and may be identical to element 80*a* which defines the bottom. Each of elements 80*a–f* includes portions adapted to snap together with corresponding mating portions on the neighboring elements. Elements 80*a–f* are preferably of molded plastic construction.

The system may be built to any desired height, subject to the clear space within the wall. As a practical matter, a height of 11 inches or so above module 80*b* is enough to store four rolls in the wall, and is normally suitable.

The installation of the snap-together system is relatively straightforward. First, element 80*f* is snapped onto element 80*e*, and the pair inserted through aperture 30 and moved upwardly to clear the aperture. Element 80*d* is then inserted, and snapped onto element 80*e*. Element 80*c* is then inserted and snapped to element 80*d*. The assembled portion is moved up and held in place by means of any convenient expedient. Element 80*a* is then placed through the aperture and moved downwardly. Element 80*b* is then placed in the wall and snapped at its top to engage element 80*c* and at its bottom to engage element 80*a*. The finished subassembly may be held in place by double-sided foam tape.

In summary, it may be seen that the present invention provides a surprisingly simple and yet effective toilet paper dispensing system that is readily built into a bathroom wall, either before or after wallboard installation. The invention is simple in that it requires few or no moving parts, and yet effectively maintains the stacked rolls in place but out of the way. While the above description and illustrations provide a full description of the preferred embodiments, various modifications, alternate constructions, and equivalents may be employed without departing from the true spirit of the invention. For example, while the channels providing the L-shaped guides are shown as recesses in side walls 37*a–b*, the channels could also be implemented as pairs of spaced ridges. Additionally, while rear wall 38 provides a fully enclosed structure (except for opening 40), wall 38 could be eliminated, or abbreviated to save material. Moreover, while opening 75 is preferably formed in the lower edge of horizontal channel 62 to facilitate roll insertion, the opening could also be formed in the upper edge. Indeed, the entire construction could be inverted, but a biasing mechanism, such as a spring-loaded platform, would be needed to replace the gravity feed. Therefore, the above description should not be taken as limiting the scope of the invention which is defined by the appended claims.

What is claimed is:

1. A toilet paper roll dispenser comprising:

a chamber adapted to be mounted within a stud wall, said chamber having internal dimensions sufficient to accommodate a stacked plurality of rolls to be dispensed, said chamber having a rear wall, first and second side walls, and a front wall, said front wall being formed at a lower portion thereof with with an opening sized to allow the rolls to pass therethrough for loading and dispensing;

first and second guides, having respective substantially uninterrupted first and second vertical channels, each extending upwardly along a respective one of said side walls, and respective first and second horizontal channels, each extending from a lower point on the corresponding vertical channel, through and beyond said opening in said front wall, to a point outside said chamber;

said first and second guides opening toward one another in facing relationship and having lateral dimensions sized to accommodate spindle ends extending beyond the end faces of the rolls; and first and second roll holder means, associated with said first and second horizontal channels, respectively, and located at respective terminal regions thereof, for establishing a position at the ends of said horizontal channels at which a roll is disposed for use;

at least said first horizontal channel being formed with an open segment to allow insertion of the spindle ends into said first and second horizontal channels, said horizontal channels and said vertical channels being configured relative to said opening and said chamber to permit a roll, the spindle ends of which are thus inserted into said horizontal channels, to pass through said opening and up into said chamber.

2. The invention of claim 1 wherein at least one of said vertical channels extends to a point below a lowermost edge of the corresponding horizontal channel to define an integral detent for preventing spontaneous movement of the lowermost roll of said stacked plurality.

3. The invention of claim 1 wherein said open segment is disposed along a lower edge of said first horizontal channel.

4. The invention of claim 1 wherein said first and second vertical channels are defined by respective recesses in said first and second side walls.

5. The invention of claim 1 wherein said chamber extends below said opening to define a lower compartment.

6. The invention of claim 1, and further comprising latch means associated with said first horizontal channel and mounted proximate said open segment for inhibiting accidental passage of the spindle ends out of said open segment.

7. A dispenser for storing a plurality of toilet paper rolls behind a wall and presenting the rolls, one at a time, for use in a position in front of the wall through a suitably dimensioned opening in the wall, said dispenser comprising:

means defining first and second L-shaped guides, each having a substantially uninterrupted vertical channel disposed behind the wall and a horizontal channel extending away from said vertical channel through the opening to a terminal region located at a point in front of the wall;

said L-shaped guides being sized to accommodate spindle ends extending beyond the rolls of toilet paper for sliding motion of the rolls therealong, and being spaced apart from one another to maintain the rolls in a captured relation;

said horizontal channels each being formed at their respective terminal regions to define roll-supporting members;

at least one of said horizontal channels having an opening sized to allow a roll having projecting spindle ends to be inserted into and between said horizontal channels and thence into said vertical channels;

the vertical channel of said first guide extending to a point below a lowermost edge of the horizontal channel of said first guide to define a detent for preventing spontaneous movement of the lowermost roll of the stacked plurality.

8. The invention of claim 7 wherein said open segment is disposed along a lower edge of the horizontal channel of said first guide.

9. A toilet paper roll dispenser comprising:

a chamber adapted to be mounted within a stud wall, said chamber having internal dimensions sufficient to accommodate a stacked plurality of rolls to be dispensed, said chamber having a rear wall, first and second side walls, and a front wall, said front wall being formed at a lower portion thereof with an opening through which a roll may pass, said chamber extending below said opening to define a lower compartment;

an outwardly-facing first flange carried by said chamber and surrounding said opening;

first and second L-shaped guides associated with said first and second side walls, respectively, each guide having a vertical channel extending upwardly along its associated side wall and a horizontal channel extending from a lower point on the corresponding vertical channel to said first flange;

said first and second guides opening toward one another in facing relationship and having lateral dimensions sized to accommodate spindle ends extending beyond the end faces of rolls to be dispensed;

the vertical channel of said first guide extending to a point below a lowermost edge of the horizontal channel of said first guide to define a detent for preventing spontaneous movement of the lowermost roll of the stacked plurality;

a frame having a second flange sized for sliding engagement with said first flange; and first and second roll-holding elements carried by said frame and formed with channel portions aligned with said horizontal channels to define terminal portions thereof when said second flange engages said first flange.

10. The invention of claim 9 wherein at least one of said horizontal channels is formed with an opening sized to allow a roll having projecting spindle ends to be inserted into and between said horizontal channels and thence into said vertical channels.

11. The invention of claim 10 wherein said opening is formed in the portion of the horizontal channel defined by the corresponding roll-holding element.

12. The invention of claim 9 wherein said terminal portions of said horizontal channels are formed with respective downward extensions to define shallow arcuate troughs.

13. The invention of claim 9 wherein said chamber is of modular snap-together construction, comprising:

a lower element defining said lower compartment;

a flanged element defining portions of said rear wall and side walls and carrying said first flange;

at least one intermediate element defining portions of said rear wall, front wall, and side walls; and an upper element defining a top of said chamber;

said lower element, said flanged element, said intermediate element, and said upper element having portions for mutual engagement, with each element being sized to pass through a rectangular aperture in the wall within which said chamber is adapted to be mounted, whereupon said chamber may be assembled within the wall from in front of the wall.

* * * * *